US006418656B1

(12) United States Patent
Christiansen

(10) Patent No.: US 6,418,656 B1
(45) Date of Patent: Jul. 16, 2002

(54) GUNSTOCK AND SCOPE MOUNTED STORAGE ASSEMBLIES

(76) Inventor: Ned F. Christiansen, 55017 Flatbush Rd., Three Rivers, MI (US) 49093

( * ) Notice: Subject to any disclaimer, the term of this patent is extended or adjusted under 35 U.S.C. 154(b) by 0 days.

(21) Appl. No.: 09/753,395

(22) Filed: Jan. 2, 2001

(51) Int. Cl.[7] ..... F41C 23/00
(52) U.S. Cl. ..... 42/90; 42/90; 42/70.01
(58) Field of Search ..... 42/90, 71.01, 124, 42/111, 72

(56) References Cited

U.S. PATENT DOCUMENTS

| | | | | |
|---|---|---|---|---|
| 711,989 A | | 10/1902 | Marble | |
| 1,051,960 A | * | 2/1913 | Kennedy | 42/70.01 |
| 1,266,024 A | * | 5/1918 | Kennedy | 42/70.01 |
| 2,476,355 A | | 7/1949 | Brown | |
| 4,276,807 A | * | 7/1981 | Whitlock | 42/70.01 |
| 4,850,127 A | | 7/1989 | Davis et al. | |
| 5,068,991 A | | 12/1991 | Reed | |
| 5,664,360 A | | 9/1997 | Conway | |
| 5,755,055 A | | 5/1998 | Thompson et al. | |
| 5,813,157 A | | 9/1998 | Scott et al. | |

FOREIGN PATENT DOCUMENTS

| | | |
|---|---|---|
| DE | 480269 | 7/1929 |

* cited by examiner

*Primary Examiner*—Michael J. Carone
*Assistant Examiner*—Lulit Semunegus
(74) *Attorney, Agent, or Firm*—Geoffrey E. Dobbin

(57) ABSTRACT

Gunstock storage assemblies for scope adjustment covers and shotgun chokes are provided. The assemblies utilize the threaded nature of such covers and chokes to provide a secure and convenient storage of the items. For adjustment covers, a cup or shaft is embedded in a gunstock. A washer and retaining mount are inserted towards the inner end of the cup or shaft and are held in place by a screw passing through the mount, washer, and cup and into the gunstock. The mount is male threaded to receive an adjustment cover. For chokes, a female threaded shaft is similarly embedded and is sized to receive a choke. Both cup and shaft may be secured with an adhesive such as epoxy.

36 Claims, 6 Drawing Sheets

GUNSTOCK AND SCOPE MOUNTED STORAGE ASSEMBLIES

FIELD OF INVENTION

The present invention relates to a system for storing scope caps on a rifle while a user is adjusting a rifle-mounted telescopic apparatus and more particularly relates to a system by which scope caps are temporarily and easily stored in the stock of a rifle.

BACKGROUND OF THE INVENTION

The use of a rifle for recreation is popular, as is the use of enhancements to increase a user's efficiency while pursuing such recreational activities as hunting or target shooting. One such enhancement is the use of a telescopic lens system, or "scope". When mounted on a rifle or shotgun, a scope enables a user to better see and aim at a distant target. However, a typical scope frequently requires adjustment to ensure accuracy. This adjustment is not always performed in a convenient location, such as one's home or a shooting range, but must be done in many circumstances in the field while hunting. This leads to the problem which this invention addresses. The adjustment screws of a scope are covered by adjustment covers, or scope caps, so as to prevent contamination of the entire adjustment system by outside elements. These scope caps must be removed and stowed while the scope is adjusted. Being relatively small, they can be easily lost or fumbled. The present invention provides a storage system that utilizes the threaded portion of scope caps and is built directly into the weapon's stock without hindering the operation of the weapon. The system is also adaptable to accommodate shotgun choke tubes.

The use of weapon mounted storage systems is known in the prior art For example, U.S. Pat. No. 5,813,157; U.S. Pat. No. 5,755,055; U.S. Pat. No. 5,664,360; U.S. Pat. No. 5,068,991; U.S. Pat. No. 4,850,127; U.S. Pat. No. 2,476,335; U.S. Pat. No. 711,989; and German Pat. No. 480,260 are all illustrative of the prior art.

SCOTT, BARRY R., ET AL

SHOTGUN STOCK WITH SHELL HOLDER

U.S. Pat. No. 5,813,157 (1998)

A shotgun stock including a shell holding compartment. The shell holding compartment is completely contained within the confines of the shotgun stock so that it does not extend outwardly in either direction from the stock. The shell holder is several clips facing either the right side or the left side of the stock. Shells may be snapped in or removed from the clip and the shells are also completely contained within the confines of the stock. Preferably, the stock includes a pistol grip portion so that the shotgun may be held in one hand. Also, preferably, the opening in the stock is divided by a partition with the clips in the rear partition and the hand holding the pistol grip is at the front of the front opening.

THOMPSON, GREGG, ET AL

SHOT SHELL BB HOLDER

U.S. Pat. No. 5,755,055 (1998)

A BB holder for a gun comprises an elongated cylindrical body having a cylindrical side wall, a bottom wall, and an open top end and a cap having a cylindrical side wall which is ensleeved over the cylindrical side wall of the body. The holder has the shape and size of a shot gun shell and is stored in a chamber in the stock of a gun. If the gun has a BB reservoir, the BB reservoir can communicate with the chamber through a port opening which is closed when the holder is inserted into the chamber.

CONWAY, JOHN

GAME CALL HOLSTER

U.S. Pat No. 5,664,360 (1997)

A holster for game calls which can be fastened around the stock of a gun or of a bow. The holster has an elongated body made of a flexible material, with a plurality of pockets formed on one side. The pockets are preferably formed so as to open toward the center of the elongated body. A fastener, such as hook-and-loop material (Velcro®) allows the elongated body to be wrapped around the gunstock and the ends fastened to each other, so as to form a sleeve around the stock with pockets on the outside. If the pockets are formed to open towards the center of the elongated body, they will open upwards when the holster is fastened around the generally horizontal gunstock. Game calls can be inserted into the pockets, and removed easily without removing the gun from the shoulder of the hunter and without startling the game. A bow-hunting variation has the pockets turned 90° so they point toward one side of the elongated body, allowing the pockets to point upwards as the elongated body is fastened to a bowstock.

REED, LARRY N.

GUNSTOCK STORAGE ASSEMBLY

U.S. Pat. No. 5,068,991 (1991)

Choke storage for shotguns is provided by the formation of a plurality of separate elongated chambers within the butt of the shotgun stock with each chamber presenting a snug fit for the removable storage of a choke. A special heel plate affixed to the stock butt is formed with one-half of a sliding male-female interlock and cooperates with the other half of this interlock being carried by a removable outermost butt plate. A simple, twist-lock device retains the butt plate in the fully installed condition wherein the butt plate presents a natural extension of the stock butt. The removable butt plate may include a recoil shoulder pad therewith.

DAVIS, WILLIAM A., ET AL

GUN STOCK INCORPORATING MAGAZINE

U. S Pat No. 4,850,127 (1989)

A gunstock incorporates a magazine for ammunition storage having a buttstock portion which includes at least one magazine having at least one magazine and port are configured to releasably retain at least one round of ammunition. Included within the magazine is a means for temporarily maintaining the round of ammunition in retained position. An inclined ramped surface is provided, in a preferred embodiment, to facilitate insertion and removal of ammunition from the magazine port.

BROWN, J. L.

GUNSTOCK CARTRIDGE HOLDER

U.S. Pat No. 2,476,355 (1948)

The invention is a cartridge holder for single cartridges of rifle ammunition utilizing a plurality of bored holes, each with a spring attached therein, and a cap plate. The springs are singly anchored pendent action springs. A single spring is mounted at the opening of each bore hole with the remainder of the spring disposed inside said bore hole. The cap plate, with corresponding holes is then installed over the bore holes. Individual cartridges are manually inserted into each bore hole and held in place until the user desires to remove them by means of the associated spring.

MARBLE, ALBERT D.

MAGAZINE FOR FIREARMS

U.S. Pat. No. 711,989 (1902)

The invention is a stock mounted magazine for rifles. The magazine comprises a metal face plate with a plurality of holes of sufficient diameter to allow an ammunition cartridge to side through with the exception of the rim and a tube configuration that is inserted into the top of the rifle's stock, said configuration providing one tube per hole in the face plate. The tubes are lined with felt or some other compressible material so that ammunition cartridges are maintained in their stowed position until the user desires to remove them.

COLLATH, FRANZ

JAGDGEWEHR

German Pat. No. 480,269 (1929)

This invention discloses a storage assembly comprising a hole of sufficient diameter bored into the stock of a gun. The hole is fitted with a flip cap to seal the opening.

While the aforementioned inventions accomplish their individual objectives, they do not describe a storage assembly utilizing a scope cap's natural threaded nature. Each of the disclosed patents utilizes either an exterior means for sealing the storage compartment in question or an internal compression device. The '991 and '127 patents even require removal of a specially designed butt plate to use the storage compartments therein. As such, the weapon can not be used simultaneously with the associated storage assembly. The '055, '355 and '989 patents allow for simultaneous use, but rely on compression, which may be problematic as internal components wear and lose flexibility over time and may fail in circumstances where the weapon is dropped. The '157 patent relies on tension in the form of clips. In this respect, the storage assembly according to the present invention departs substantially from the usual designs in the prior art. In doing so, this invention provides a storage assembly utilizing mated threading to hold scope caps and shotgun chokes in such a way that use of the weapon is not prohibited while using the storage assembly and the scope caps and chokes may be held indefinitely in a secure manner if needed.

SUMMARY OF THE INVENTION

In view of the foregoing disadvantages inherent in the known types of gun mounted storage assemblies, this invention provides an improved scope cap and choke storage assembly. As such, the present invention's general purpose is to provide either a new and improved stock contained or scope mounted storage assembly that will allow for unhindered use of both the storage assembly and the weapon simultaneously while maintaining a secure hold on the object desired to be stowed.

To attain this, the invention essentially comprises a suitably sized hole bored into the side or underside of the weapon's stock. To store shotgun chokes, a cylindrical shaft having a female threaded end is also provided. The threaded end of the shaft is positioned inner most with respect to the hole bored into the stock. The shaft is suitably sized to receivably hold a shotgun choke by inserting the choke through the shaft and screwing the choke into the female threaded end of the shaft. The shaft is held in place by mechanical or chemical means. For scope caps, a similar unthreaded shaft, or cup, is provided. Also provided is a retaining mount and a resilient washer. The washer is sized to cover the entire bottom surface of the cup/hole and the retaining mount is sized slightly smaller, sufficient for a scope cap to be inserted into the shaft and engage the sloping circumference of the mount. When completely mounted, the scope cap also engages the resilient washer, which then impedes rotational movement of the scope cap that may cause disengagement with the storage assembly. The washer also aids in weatherproofing the system. The mount and washer are generally held in place by a retaining screw, rivet, or some other device. The mount may be threaded for specific types of scope caps or may be manufactured of a softer material that would allow scope caps to self-thread the mount. As another alternative embodiment, at least one mount may be attached externally to the scope.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide instant and secure storage of scope caps and shotgun chokes on the stock of a weapon.

It is another object of the invention to provide a storage system that would allow access to scope caps while simultaneously allowing use of the weapon.

It is still another object of the invention to provide a storage system that is readily adaptable to the sizes and threading commonly used in the manufacture of scope caps and shotgun chokes.

It is a further object to provide a storage system that will aid in weatherproofing scope caps and chokes while they are stowed.

A still further object of the invention is to provide a storage system, the manufacture and installation of which is relatively easy and economical so as to keep the cost to the consumer reasonable.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
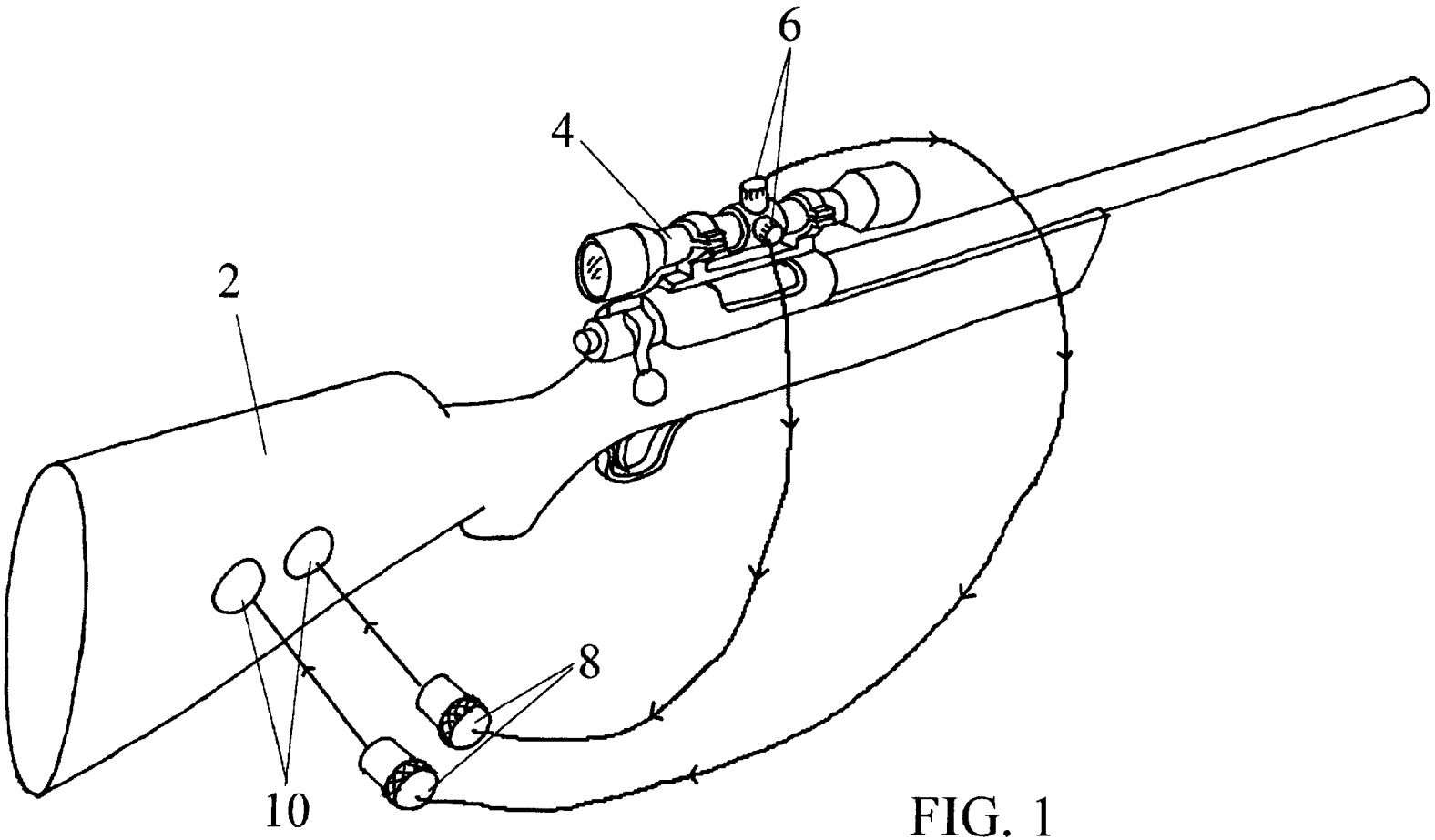
FIG. 1 is a perspective view of a rifle with the scope cap version of the invention installed in duplicate.

With reference now to the drawings, the preferred embodiment of the gunstock storage assembly embodying the principles and concepts of the present invention will be described. With specific reference to FIG. 1, a rifle with a mounted scope 4 may be seen. Scope 4 has two adjustment fittings 6 which are normally covered with adjustment covers 8. For storage purposes, two individual storage assemblies 10, one for each cover 8, are machined into the stock 2.

Figure 2:
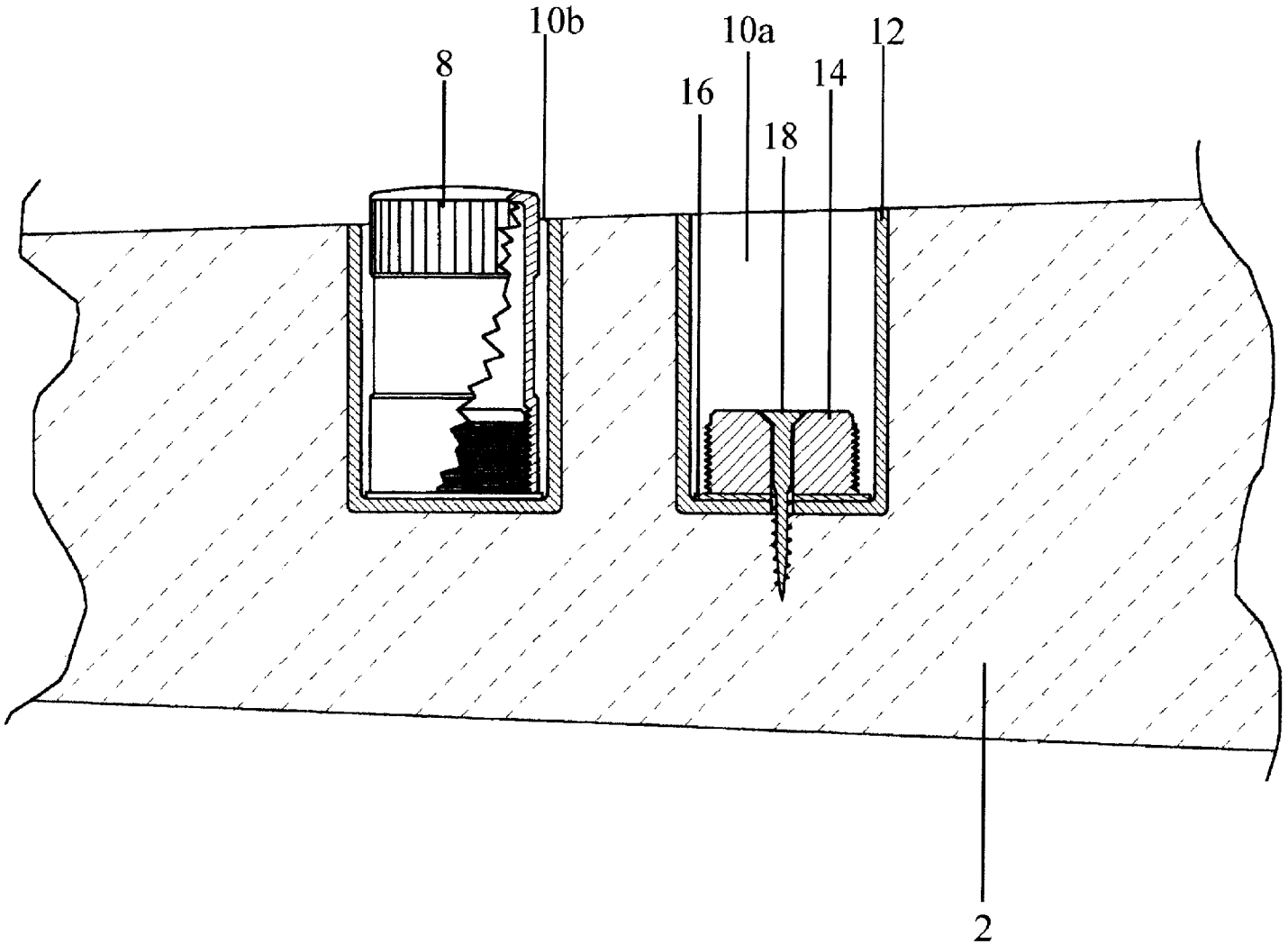
FIG. 2 is a cross-sectional view of the same rifle of FIG. 1, taken from the top of the rifle, with a scope cap positioned in the invention.

Referring now to FIG. 2, storage assembly 10*a* is installed by boring a hole in the weapon's stock 2. An assembly cup 12 is then inserted into the hole. Cup 12 may be manufactured of metal, plastic, or some other suitable rigid material. Hole depth and width and cup size would depend on the brand of scope 4 used on the weapon. A resilient washer 16 is then placed inside each cup and then a retaining mount 14 is placed next to washer 16. Washer 16, mount 14 and cup are positioned so that they have a common central axis. In the preferred embodiment, a screw 18 then axially affixes mount 14, washer 16 and cup 12 to each other and to the stock 2. As an alternative, epoxy or some other adhesive may be used to further adhere, or as the sole means of affixing, cup 12 to stock 2. If an adhesive is used as the sole fastening means, then some other means, such as an adhesive or a rivet must then be used to affix the mount 14, washer 16 and cup 12 together. Another alternative would be to replace cup 12 with a shaft, which would be epoxied into the hole and allow washer 16 to engage the bottom of the hole directly. Particular sizes, including thread size, would be dependent on the size and dimensions of the scope adjustment cover 8 used. Assembly 10*b* has scope adjustment cover 8 installed. Ideally, mount 14 is male threaded and is sized to receive cover 8 through a threaded engagement. However, in another embodiment, mount 14 may instead be a resilient, unthreaded frustoconical piece so as to allow any adjustment cover 8 to self-thread mount 14. Mount 14 should be short enough to allow cover 8 to abut washer 16 and simultaneously provide a secure hold. Assembly cup 12 is sized to allow this engagement and defines the original hole diameter and depth. As can be seen in FIG. 2, the adjustment cover 8 is preferred to be mostly inserted within the assembly 10*b* with only a sufficient projection of adjustment cover 8 outside of assembly 10*b* to allow removal of cover 8. However, any amount of coverage and projection would be considered within the scope of this invention. It should also be noted that the preferred number of assemblies 10 is two as there are usually two adjustment covers 8, though the invention may be practiced with any number of assemblies 10. Assemblies 10 may also be positioned anywhere on stock 2.

Figure 3:
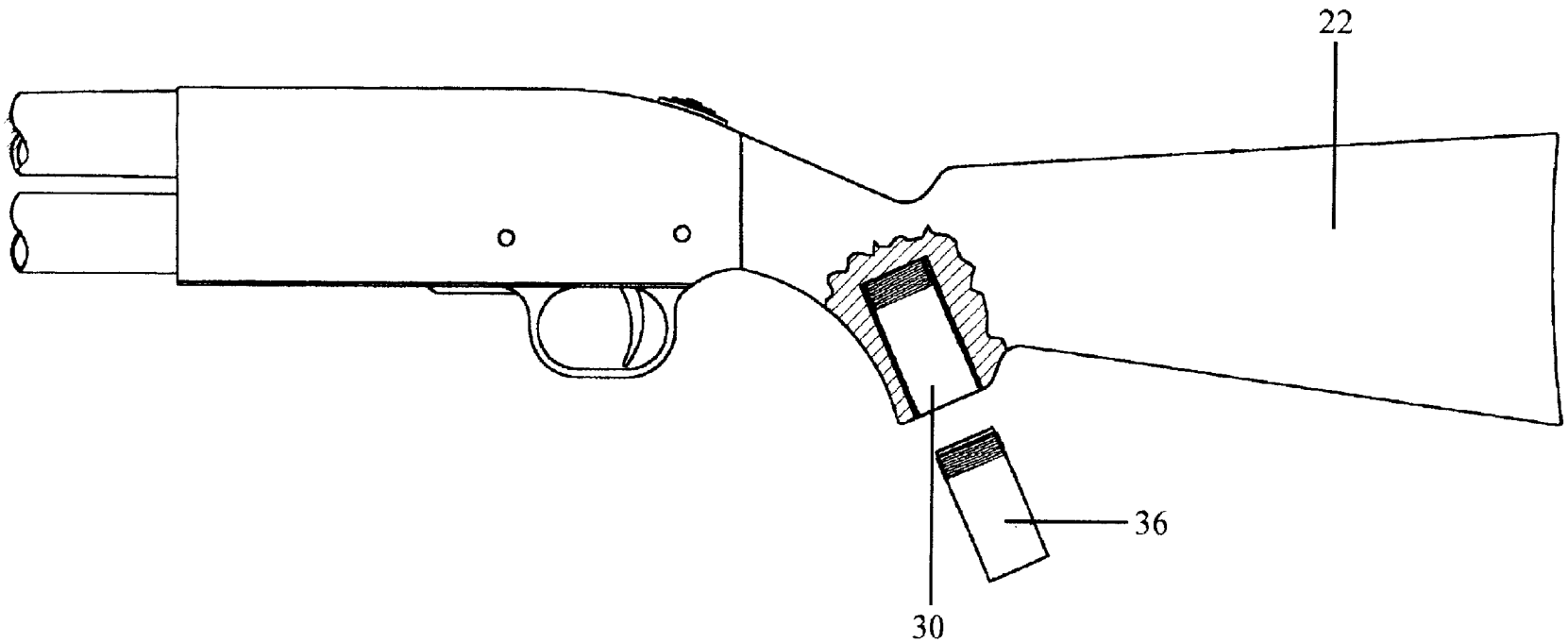
FIG. 3 is a side plan view of a shot gun with the shotgun choke version of the invention installed and a portion of the shotgun stock cut away.
Figure 4:
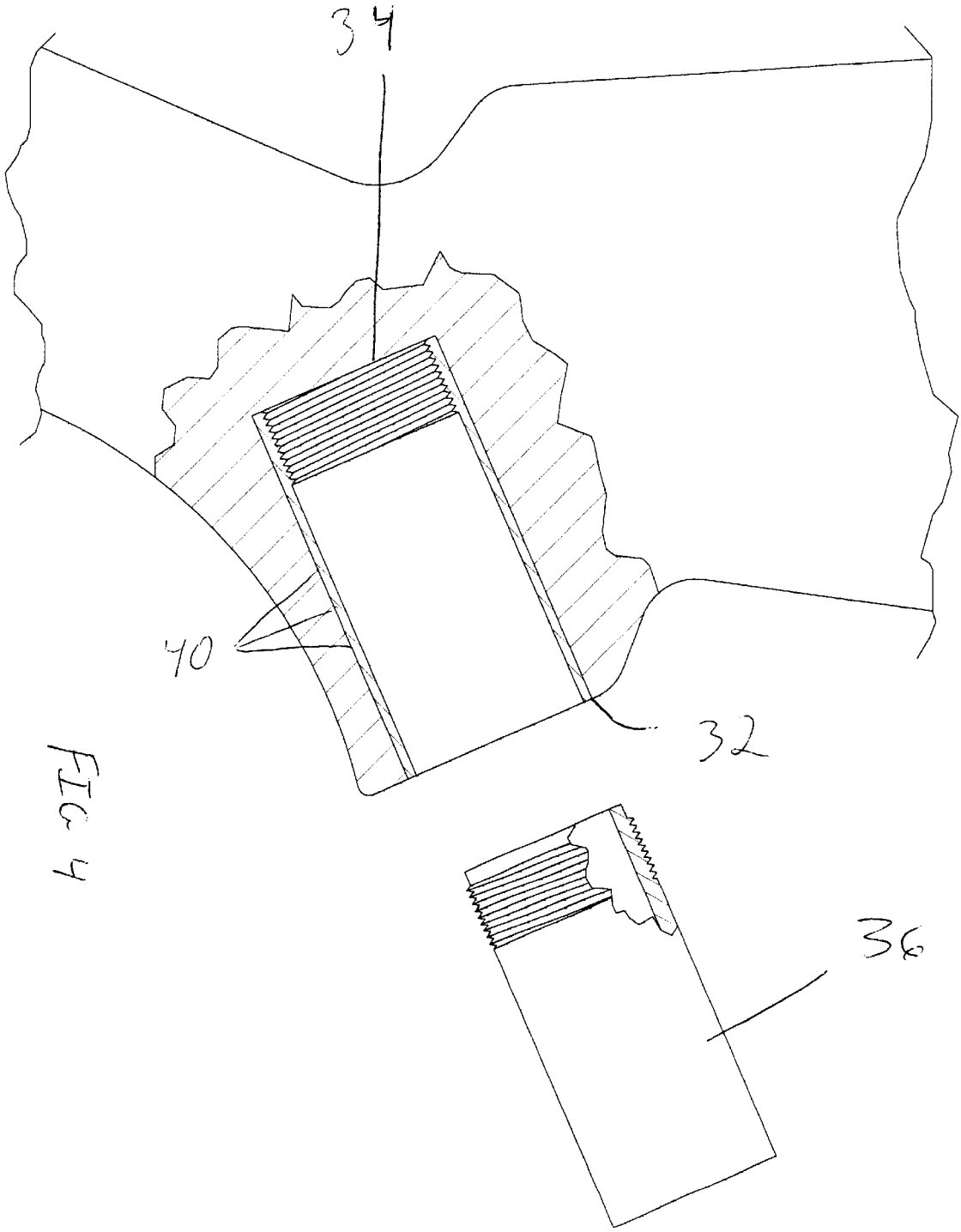
FIG. 4 is a close-up view of the same shotgun along the same lines and conditions as FIG. 3 also showing a choke tube about to be inserted into the invention.

The invention may also be practiced with shotgun chokes, as shown in FIGS. 3 and 4. As shown in FIG. 3, an assembly 30 is inserted into a hole bored into stock 22. Referring to FIG. 4, the assembly 30 comprises a female threaded shaft, held into the hole bored into stock 22 by means of an adhesive such as epoxy. Annular grooves 40 are provided in stock 22 and shaft 32 to allow better hold by the epoxy. The shaft's threaded end 34 is inserted furthermost in the hole so as to allow maximum coverage of male threaded choke 36. The shaft 32 is sized and shaped to allow threaded engagement between it and choke 36. Shaft 32 may also be a cup as with the adjustment cover embodiment and further may be affixed to the gunstock with a screw. In the cup embodiment, a resilient washer may also be added to aid in weather proofing and retention as with the adjustment cover embodiment. As with the adjustment cover embodiment of the invention, number, position and size of any assemblies are variable.

Figure 5:
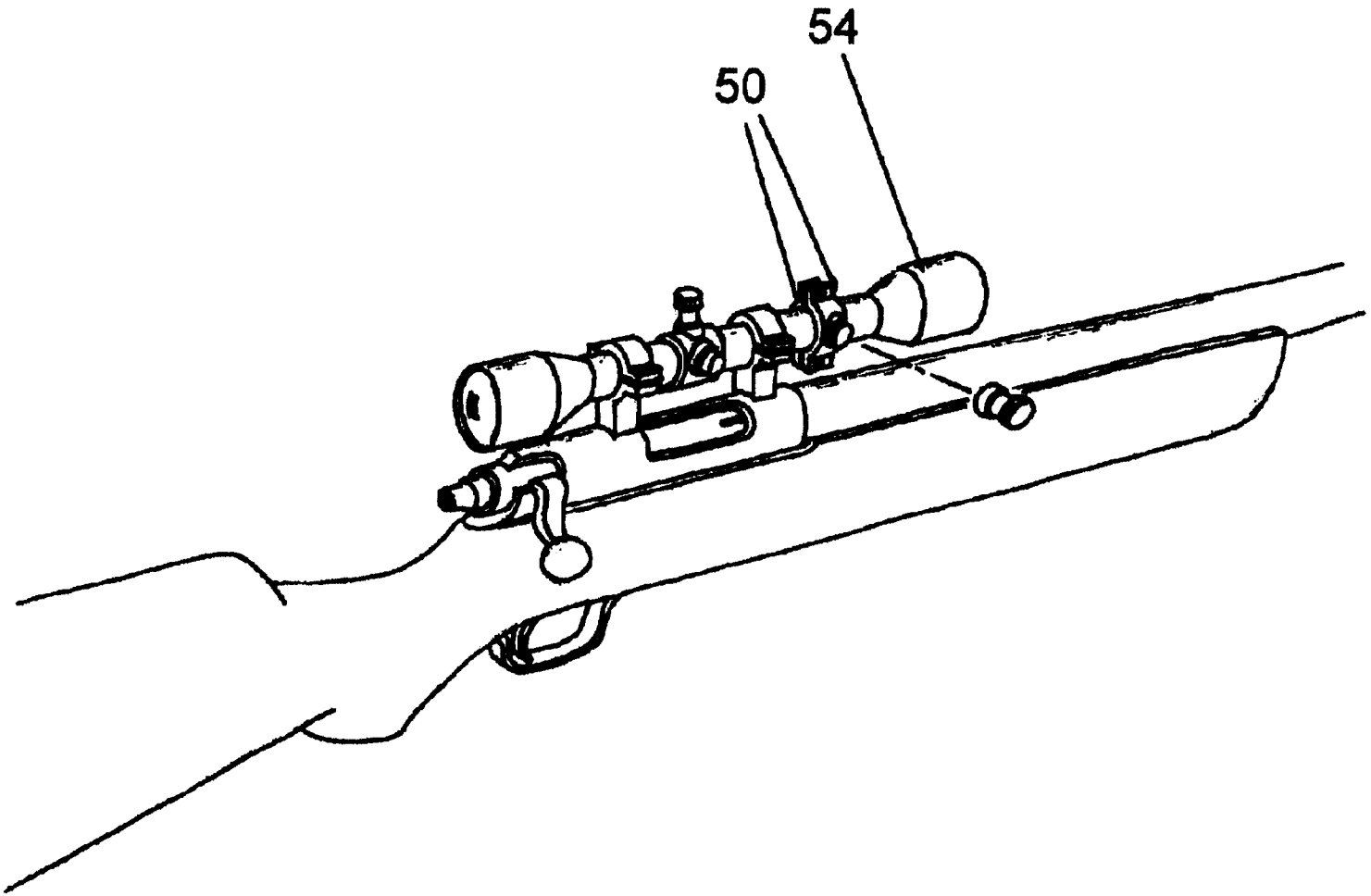
FIG. 5 is a perspective view of the scope mounted version of the invention installed.
Figure 6:
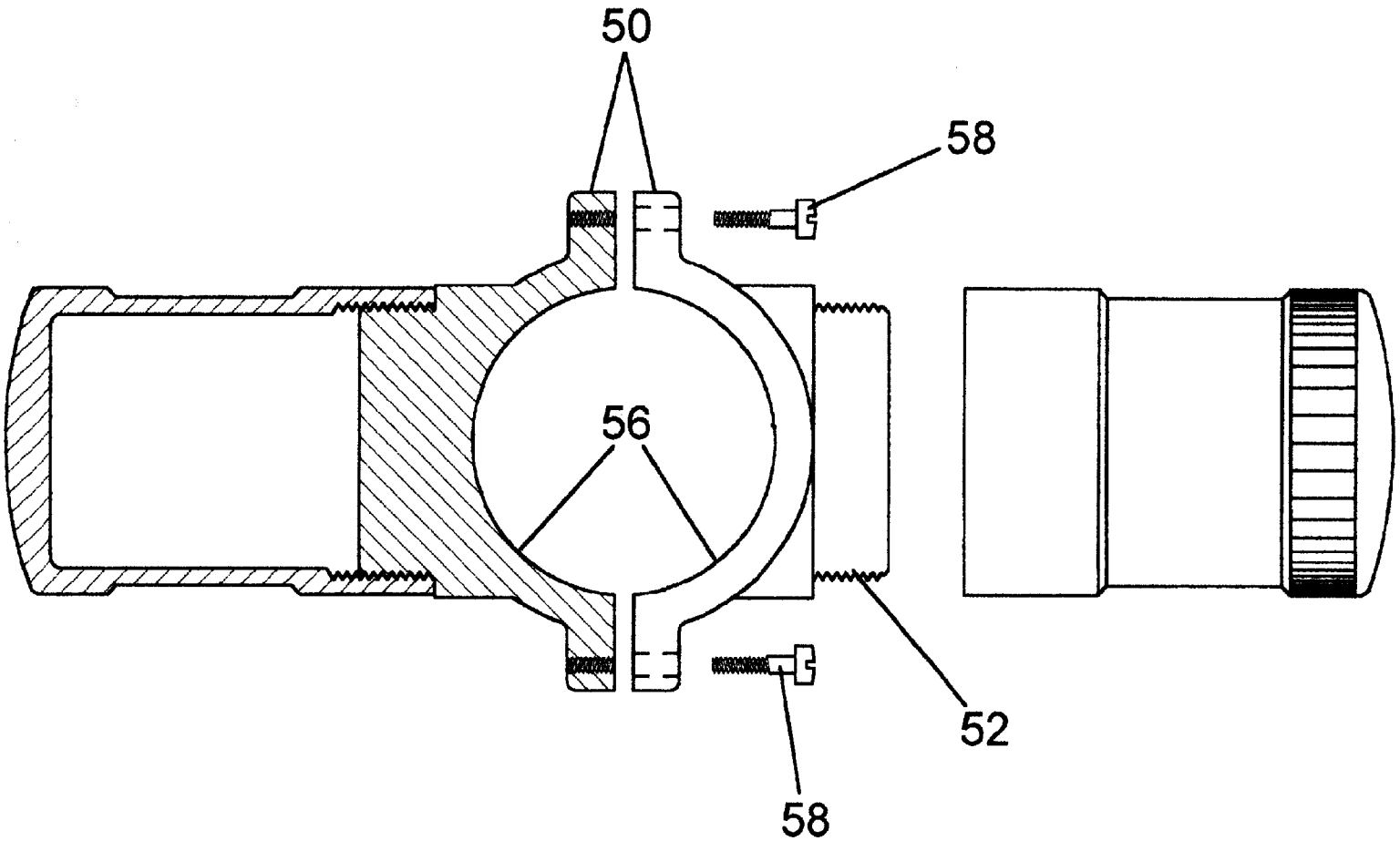
FIG. 6 is a close-up perspective view of the invention shown in FIG. 5.

Another embodiment of the invention is a scope mounted version for adjustment covers. As shown in FIGS. 5 and 6, two identical and curved brackets 50 are each fitted with a mount 52 opposite the curvature of the brackets 50. The brackets' and mounts' sizes are determined by the type of scope 54. The curved areas 56 of the brackets 50 abut the scope and in the preferred embodiment, a plurality of bolts 58 hold the brackets 50 together around scope 54. This allows mounts 52 to face outwardly from the scope 54. The mount 52 and bracket 50 combination may be molded of one piece or may be attached together by a rivet, screw, bolt, adhesive or some other suitable means.

Although the present invention has been described with reference to preferred embodiments, numerous modifications and variations can be made and still the result will come within the scope of the invention. No limitation with respect to the specific embodiments disclosed herein is intended or should be inferred.

I claim:

1. For a gun with a gunstock, a gunstock storage assembly for scope adjustment covers comprising:

a. a male-threaded cylindrical retaining mount, defining a central axis and suitably sized and threaded to threadingly engage a female-threaded scope adjustment cover;

b. a resilient washer, defining a central axis;

c. an assembly cup further comprised of a cylindrical shaft having one end closed and further defining a central axis; and, d. at least one affixing means;

wherein at least one such assembly is installed in the gunstock by inserting the assembly cup into a suitably sized cylindrical hole bored into the gunstock with the open end flush with and facing the outside surface of the stock, the washer is placed against the closed end of the cup and the mount is inserted against the washer so that the cup, washer and mount all share the same central axis and the affixing means connect the mount to the washer, the washer to the cup and cup to the gunstock.

2. The assembly of claim 1, further comprising a plurality of annular grooves fashioned in the gunstock's hole and the exterior surface of the cup and an adhesive is used to further fasten the cup to the gunstock.

3. The assembly of claim 2, wherein the adhesive is selected from the group consisting of epoxy, glue, wood putty, and ceramic.

4. The assembly of claim 2, wherein a shaft is substituted for the assembly cup and the washer abuts the bottom of the gunstock's hole.

5. The assembly of claim 4, wherein the adhesive is selected from the group consisting of epoxy, glue, wood putty, and ceramic.

6. The assembly of claim 1, wherein the retaining mount is comprised of a resilient material, sufficient to allow an adjustment cover to self-thread the retaining mount.

7. The assembly of claim 6, further comprising a plurality of annular grooves fashioned in the gunstock's hole and the exterior surface of the cup and adhesive is used to further fasten the cup to the gunstock.

8. The assembly of claim 7, wherein the adhesive is selected from the group consisting of epoxy, glue, wood putty, and ceramic.

9. The assembly of claim 7, wherein a shaft is substituted for the assembly cup and the washer abuts the bottom of the gunstock's hole.

10. The assembly of claim 9, wherein the adhesive is selected from the group consisting of epoxy, glue, wood putty, and ceramic.

11. The assembly of claim 1, wherein the affixing means is a single screw driven along the defined central axis through the mount, washer and assembly cup and into the gunstock.

12. The assembly of claim 11, further comprising a plurality of annular grooves fashioned in the gunstock's hole and the exterior surface of the cup and an adhesive is used to further fasten the cup to the gunstock.

13. The assembly of claim 12, wherein the adhesive is selected from the group consisting of epoxy, glue, wood putty, and ceramic.

14. The assembly of claim 12, wherein a shaft is substituted for the assembly cup and the washer abuts the bottom of the gunstock's hole.

15. The assembly of claim 14, wherein the adhesive is selected from the group consisting of epoxy, glue, wood putty, and ceramic.

16. The assembly of claim 11, wherein the retaining mount is comprised of a resilient material, sufficient to allow an adjustment cover to self-thread the retaining mount.

17. The assembly of claim 16, further comprising a plurality of annular grooves fashioned in the gunstock's hole and the exterior surface of the cup and adhesive is used to further fasten the cup to the gunstock.

18. The assembly of claim 17, wherein the adhesive is selected from the group consisting of epoxy, glue, wood putty, and ceramic.

19. The assembly of claim 17, wherein a shaft is substituted for the assembly cup and the washer abuts the bottom of the gunstock's hole.

20. The assembly of claim 19, wherein the adhesive is selected from the group consisting of epoxy, glue, wood putty, and ceramic.

21. For a shotgun with a gunstock, a gunstock storage assembly for shotgun chokes comprising:

a. an assembly cup further comprised of a cylindrical shaft having one end closed and female threaded, said closed end having a slightly smaller diameter than the open end so as to allow a male threaded shotgun choke to threadably engage with the cup and further defining a central axis; and, b. a screw;

wherein at least one such assembly is installed in the gunstock by inserting the assembly cup into a suitably sized cylindrical hole bored into the gunstock with the open end flush with and facing the outside surface of the stock, and the screw is axially driven through the cup, fastening it to the gunstock through the bottom of the hole.

22. The assembly of claim 11, further comprising a plurality of annular grooves fashioned in the gunstock's hole and the exterior surface of the cup and an adhesive is used to further fasten the cup to the gunstock.

23. The assembly of claim 12, wherein the adhesive is selected from the group consisting of epoxy, glue, wood putty, and ceramic.

24. The assembly of claim 12, wherein a shaft is substituted for the assembly cup and the screw is omitted.

25. The assembly of claim 14, wherein the adhesive is selected from the group consisting of epoxy, glue, wood putty, and ceramic.

26. The assembly of claim 11, further comprising a resilient washer, axially mounted against the closed end of the assembly cup with the screw.

27. The assembly of claim 16, further comprising a plurality of annular grooves fashioned in the gunstock's hole and the exterior surface of the cup and an adhesive is used to further fasten the cup to the gunstock.

28. The assembly of claim 17, wherein the adhesive is selected from the group consisting of epoxy, glue, wood putty, and ceramic.

29. For a gun with a mounted scope, a scope mounted adjustment cover storage assembly comprising:

a. two brackets, having both inner and outer sides and a curvature sufficient to accommodate a scope when the inner surface is abutted to the scope;

b. at least one mount attached to the outer surface of each bracket; and c. an affixing means to attach the two brackets together with their respective inner sides abutting the scope;

wherein the mounts are shaped and sized to threadably engage scope adjustment covers.

30. The assembly of claim 29, wherein the affixing means is a plurality of screws.

31. The assembly of claim 30, wherein a single mount and a single bracket are manufactured from one piece.

32. The assembly of claim 30, wherein the a single mount and a single bracket are joined together by an attachment means.

33. The assembly of claim 32, wherein the attachment means is selected from the group consisting of screws, bolts, rivets, glues, welding and epoxies.

34. The assembly of claim 29, wherein a single mount and a single bracket are manufactured from one piece.

35. The assembly of claim 29, wherein the a single mount and a single bracket are joined together by an attachment means.

36. The assembly of claim 35, wherein the attachment means is selected from the group consisting of screws, bolts, rivets, glues, welding and epoxies.

* * * * *